US005154575A

United States Patent [19]

Bonner

[11] Patent Number: 5,154,575

[45] Date of Patent: Oct. 13, 1992

[54] THERMAL BLADE TIP CLEARANCE CONTROL FOR GAS TURBINE ENGINES

[75] Inventor: Kurt J. Bonner, Maineville, Ohio

[73] Assignee: United Technologies Corporation, Hartford, Conn.

[21] Appl. No.: 724,289

[22] Filed: Jul. 1, 1991

[51] Int. Cl.[5] ..... F01D 25/26

[52] U.S. Cl. ..... 415/136; 415/134; 415/173.6; 415/173.7

[58] Field of Search ..... 415/173.1, 173.3, 173.6, 415/173.7, 174.2, 173.2, 177, 136, 138, 134

[56] References Cited

U.S. PATENT DOCUMENTS

| | | | |
|---|---|---|---|
| 4,008,978 | 2/1977 | Smale | 415/134 |
| 4,101,242 | 7/1978 | Coplin et al. | 415/134 |
| 4,398,866 | 8/1983 | Hartel et al. | 415/173.3 |
| 4,522,559 | 6/1985 | Burge et al. | 415/177 |
| 4,596,116 | 6/1986 | Mandet et al. | 415/173.4 |

*Primary Examiner*—Thomas E. Denion
*Attorney, Agent, or Firm*—Russell M. Lipes, Jr.

[57] ABSTRACT

An axial-flow compressor in which rotor blade clearance, in an area where the stator case surrounding a rotor blade stage is unsupported, is controlled by the cross-sectional area of a ring surrounding the stator case and by a gap between the inner surface of the ring and the outer surface of the stator case established at the time of compressor build.

2 Claims, 1 Drawing Sheet

THERMAL BLADE TIP CLEARANCE CONTROL FOR GAS TURBINE ENGINES

The invention was made under a U.S. Government contract and the Government has rights herein.

DESCRIPTION

1. Technical Field

This invention relates to the control of compressor blade tip clearance in axial-flow gas turbine engines.

2. Background Art

In axial-flow gas turbine engines, particularly larger ones, it is desirable to achieve thermal growth compatibility between the tips of rotating compressor blades and the surrounding casing to reduce interference and increase engine performance.

The gas turbine engine construction shown in U.S. Pat. No. 4,101,242 includes rings surrounding the engine casing and acting as thermal masses for reducing blade tip clearance changes.

SUMMARY OF THE INVENTION

An object of the invention is an axial-flow gas turbine engine compressor casing construction which provides for thermal compatibility between the rotating compressor blades and the surrounding casing with maximum casing strength and minimum casing weight.

Another object of the invention is an axial-flow gas turbine engine compressor casing construction which provides control of the clearance of rotating compressor blades under both steady state and transient operating conditions.

Still another object of the invention is the provision of a relatively simple, cost and weight effective structure for controlling blade tip clearances in the downstream portion of a high pressure axial-flow gas turbine engine compressor.

The foregoing and other objects, features and advantages will be apparent from the specification and claims and from the accompanying drawing which illustrates an embodiment of the invention.

BEST MODE FOR CARRYING OUT THE INVENTION

Figure 1:
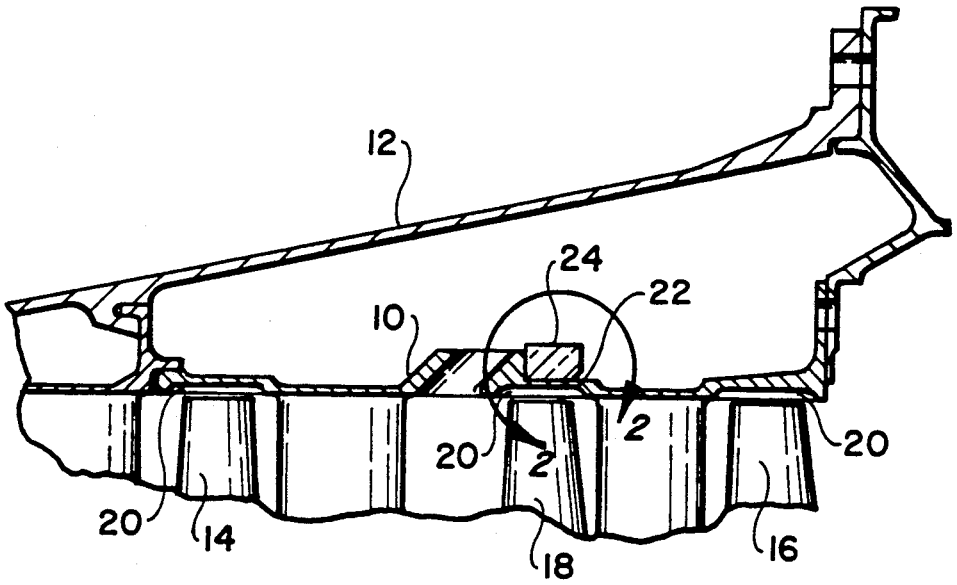
FIG. 1 is a partial section through the high pressure compressor of an axial-flow gas turbine engine showing the invention.

As shown in FIG. 1, high pressure inner stator case 10 is supported by titanium outer case 12 near rotor blade stages 14 and 16 which are surrounded by the case. Rotor blade stage 18 is between blade stages 14 and 16, and each of the blade stages is surrounded by an annular outer air seal 20 fitting within an appropriate channel, such as channel 22 opposite blade stage 18, within stator case 10. The outer air seal surrounding blade stage 18, contrary to the outer air seals surrounding blade stages 14 and 16, is not supported by relatively low temperature structure such as outer case 12. Temperatures in this region of the compressor dictate that inner stator case 10 be made of a material having strength and light weight but also a high thermal expansion. For these reasons and the fact that the case structure in the region of blade stage 18 is very thin, the stator case expands too much and responds too quickly to adequately control clearance between the tips of the blades in blade stage 18 and surrounding air seal 20.

Figure 2:
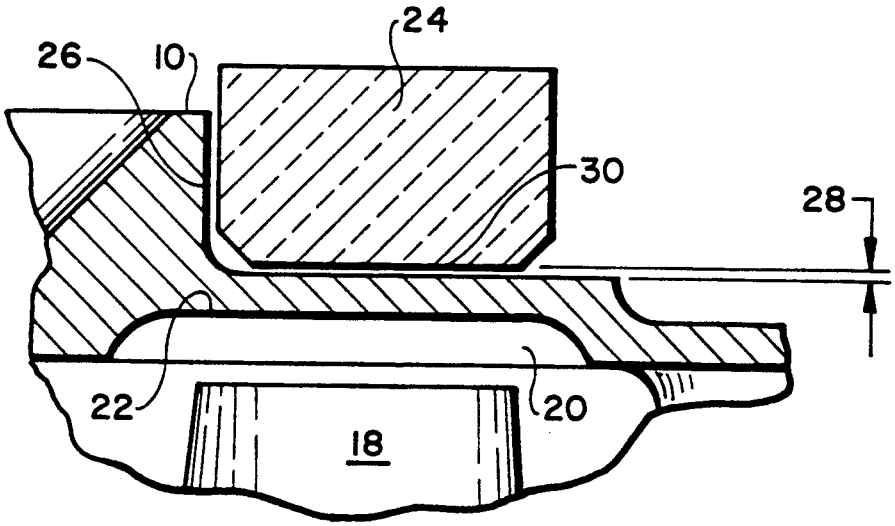
FIG. 2 is an enlarged view of a portion of the structure of FIG. 1.

To reduce the thermal growth and response of the outer air seal surrounding blade stage 18, as well as the portion of stator case 10 in that area, ring member 24 constructed of a material with a lower thermal expansion rate than that of stator case 10 is placed around the outer diameter of the stator case in line with blade stage 18. The ring member is not directly connected to stator case 10, and axial restraint is provided in one direction by shoulder 26 on the stator case and in the other direction by a restraint not shown. The ring member material would have a coefficient of expansion which is about half that of the stator case material. The cross-section area of ring member 24 and build gap 28, as shown in FIG. 2, between the outer surface of stator case 10 and inner surface 30 of the ring member are established so that desired blade tip clearances are obtained during operation.

By virtue of the casing and ring member structure, thermal growth restraint of blade stage 18 outer air seal 20, for steady state clearance control, is provided by the smaller radial growth of ring member 14 relative to stator case 10. Slower thermal response of stator case 10, for transient control clearance, is provided by the ring member's added mass and isolation from compressed air flow path temperatures. The combination of the steady state and transient clearance control effects provides a weight and cost effective structure for overall optimal rotor blade clearance control.

It should be understood that the invention is not limited to the particular embodiment shown and described herein, but that various changes and modifications may be made without departing from the spirit or scope of this concept as defined by the following claims.

I claim:

1. In a casing for an axial-flow compressor having at least three rotor blade stages, stator case means surrounding said rotor blade stages, said stator case means being of a material having a relatively high thermal expansion and having an unsupported axial length about the middle of said at least three rotor blade stages, air seal means surrounding said middle rotor blade stages and contained in channel means within said stator case means, ring member means surrounding said stator case means in line with said middle rotor blade stage and having an inner surface, said ring member means being of a material having a lower thermal expansion rate than the material of said stator case means and its inner surface has a gap with the surrounded stator case means at the time the compressor is built.

2. A casing for an axial-flow compressor in accordance with claim 1 in which the material for the ring member means has a thermal expansion rate about half of that of the material for the stator case means.

* * * * *